US007325284B2

(12) United States Patent
Lane et al.

(10) Patent No.: US 7,325,284 B2
(45) Date of Patent: Feb. 5, 2008

(54) APPARATUS AND METHOD FOR TEXTURIZING YARN

(76) Inventors: Jerry Lane, 5439 Old U.S. 41 N., Hahira, GA (US) 31632; Louie Earl Seago, 5996 NW. CRoad 150, Greenville, FL (US) 32331

( * ) Notice: Subject to any disclaimer, the term of this patent is extended or adjusted under 35 U.S.C. 154(b) by 0 days.

(21) Appl. No.: 11/773,870

(22) Filed: Jul. 5, 2007

(65) Prior Publication Data

US 2007/0251208 A1 Nov. 1, 2007

Related U.S. Application Data

(62) Division of application No. 10/977,808, filed on Oct. 28, 2004, now Pat. No. 7,278,191.

(60) Provisional application No. 60/615,110, filed on Oct. 1, 2004.

(51) Int. Cl.
*D02G 1/12* (2006.01)

(52) U.S. Cl. ..... 28/269; 28/263; 28/253

(58) Field of Classification Search ..... 28/262–267, 28/258, 268, 269, 270, 116, 134, 250, 248, 28/251, 247, 221; 26/18.6; 57/351, 332, 57/334, 344, 346, 348, 90, 352; 226/181, 226/182, 183, 185; 242/615.2
See application file for complete search history.

(56) References Cited

U.S. PATENT DOCUMENTS 552,657 A * 1/1896 Bedale ..... 57/348
2,575,781 A * 11/1951 Barach ..... 28/267
3,022,545 A * 2/1962 Wylde et al. ..... 28/267
3,110,076 A * 11/1963 Trifunovic et al. ..... 28/264
3,162,924 A * 12/1964 Richeson ..... 28/269
3,200,466 A * 8/1965 Duga et al. ..... 28/251
3,241,195 A * 3/1966 Baer ..... 19/0.56
3,253,314 A * 5/1966 Shattuck ..... 28/265
3,273,220 A * 9/1966 Rosenstein ..... 28/268
3,305,897 A * 2/1967 Meibohm ..... 28/267
3,309,751 A * 3/1967 Heijnis et al. ..... 28/265
3,387,349 A * 6/1968 Trifunovic et al. ..... 28/258
3,406,436 A * 10/1968 Clarke, Jr. ..... 28/250
3,529,045 A * 9/1970 Rosenstein ..... 28/269

(Continued)

*Primary Examiner*—Amy B. Vanatta
(74) *Attorney, Agent, or Firm*—Needle & Rosenberg, P.C.

(57) ABSTRACT

A texturizing apparatus comprising a drive housing having a false twist inlet to allow a plurality of yarns to enter the drive housing, a pair of opposing counter-rotating nip rollers positioned downstream of the false twist inlet, each nip roller having a circumferential drive surface adapted to engage the plurality of yarns and at least one circumferential spacer surface, and means for applying compression to one of the nip rollers to force the at least one circumferential spacer surfaces of the pair of nip rollers toward each other. The drive housing further having a drive outlet positioned downstream of the pair of counter-rotating nip rollers through which the plurality of yarns may exit the drive housing. The texturizing apparatus can also include a stuffer box having at least one movable flapper door and a box inlet positioned proximate the box inlet and of a size to allow the plurality of yarns to enter the interior of the suffer box. The stuffer box has a box outlet through which the yarns may exit the interior of the suffer box, which has an opening size partially defined by the at least one movable flapper door.

25 Claims, 9 Drawing Sheets

U.S. PATENT DOCUMENTS 3,848,300 A * 11/1974 Fuchs et al. ..... 28/269
3,946,469 A * 3/1976 Benson ..... 28/264
4,912,821 A * 4/1990 Mutsuo ..... 28/265
5,025,538 A * 6/1991 Saleh ..... 28/263
5,074,016 A * 12/1991 Meyer ..... 28/263
5,414,987 A * 5/1995 Knoff et al. ..... 57/282
5,647,109 A * 7/1997 Steiner et al. ..... 28/263
5,860,201 A * 1/1999 Dollhopf ..... 28/263
6,141,843 A * 11/2000 Hegenbarth et al. ..... 28/263
6,302,308 B1 * 10/2001 Hoover et al. ..... 226/90
6,385,827 B1 * 5/2002 Stewart et al. ..... 28/263
6,481,072 B1 * 11/2002 Hoover et al. ..... 28/263

* cited by examiner

APPARATUS AND METHOD FOR TEXTURIZING YARN

CROSS-REFERENCE TO RELATED APPLICATIONS

This application is a Divisional of U.S. Utility patent application Ser. No. 10/977,808, entitled "Apparatus And Method For Texturizing Yarn," filed on Oct. 28, 2004, now U.S. Pat. No. 7,278,191 which claims priority to and the benefit of U.S. Provisional Application No. 60/615,110, filed on Oct. 1, 2004, all of which are incorporated in their entirety in this document by reference.

FIELD OF THE INVENTION

The present invention relates to the field of textiles and, more particularly, to the textile handling, texturizing, or manufacturing industries.

BACKGROUND

A large portion of carpets used in residences are known as pile carpets formed by tufting pile yarn into a primary backing material. The yarns tufted into the primary backing form the fibrous face of the carpet. The tufted loops can optionally be cut or sheared to form tufts of a desired, constant vertical height.

Two general categories of tufted carpets are (1) a textured style, in which the tufts and the individual filaments or staples have varying degrees of crimp or curl; and (2) a straight-set style, in which the filaments or staples at the tuft tip are straight and substantially perpendicular to the plane of the carpet face. Addressing the first category of carpets, yarn that is used as pile in textured style carpets is prepared by cabling together a plurality of single yarns and setting them in their twisted condition. One option is to use a stuffer box to produce textured yarn having a desirable appearance and texture when tufted into the primary backing. The purpose of the stuffer box is to put texture in the twisted yarn. Stuffer boxes are well know in the art and are exemplified by one major stuffer box brand that uses the tradename Superba®.

During operation of such a stuffer box, uncrimped yarn is transported by a pair of counter-rotating nip rolls into and through a confined zone within the interior of the stuffer box. There, the yarn is caused to be folded and compressed into a fine crimp configuration. The crimps in the yarn can then be heat set, which "locks in" or sets the texture to make it of a lasting nature. The more the yarns are textured, the lighter the color because more light is reflected from the crimps and elbows formed into the yarns.

The latter type of carpet, the straight-set style, does not use a stuffer box in the production line. As such, the filaments or staples at the tuft tip are straight and substantially perpendicular to the plane of the carpet face. Without processing the yarns through a stuffer box and texturizing the yarns prior to tufting into the primary backing, the untextured carpet has a darker appearance than that of a carpet that was formed using the identical yarn strands processed in a stuffer box and then heat set.

The textured-style carpets are more popular than the straight-style carpet because, for example, the texturizing characteristics assist in hiding footprints and vacuum tracks. The step of texturizing the yarns with the stuffer box, however, creates some issues that do not exist when producing the straight-style carpet. One such recurring problem arises after a shutdown of the heat-set production line, which occurs periodically for doffing the winders, other planned line stops, and aberrant conditions that may arise during operations. Once operations resume, some of the yarns have a lighter appearance than yarns processed during normal operating conditions, i.e., before and after the shutdown.

It has been found that the yarns remaining within the stuffer box during and through the shutdown result in lighter colors due to overcrimping. The yarn remains in the stuffer box and cools, allowing the finish on the yarn to coagulate. This yarn obtains too much texture by remaining in the stuffer box longer than the normal processing time. The lighter appearance of the overly textured yarns is particularly apparent when they are tufted into the primary backing and appear as light streaks in fiberous face of the tufted carpets. These lighter sections of the tufted carpet, located between yarns processed by the stuffer box during normal operations, are unacceptable from a quality-control standpoint and are not marketable.

Additionally, the current stuffer box configuration contains a number of pinch-points wherein portions of the yarn filaments get caught, causing the heat-set production line to be shut down by the operator.

SUMMARY

The present invention addresses the problems in the art and eliminates or minimizes the amount of carpet that must be wasted as a result of overly texturizing the yarn during a shutdown. More specifically, in one aspect, the present invention comprises an apparatus and method that involves injecting a heated fluid, such as, for example, steam, into a manifold that is positioned about the exterior of a stuffer box through which the yarn passes, immediately after shutdown of a drive housing that feeds the inlet of the stuffer box. The heated fluid passes through at least one conduit in the manifold and transfers heat to the stuffer box and thence to the interior of the stuffer box to heat at least a portion of the yarn disposed therein to a desired temperature.

In the present invention, the degree of crimping of the yarns located within the interior of the stuffer box during the period of shutdown maintains a texture closer to that of the yarns processes in the stuffer box during normal operations. Thus, compared to the prior art practices, the stuffer box of the present invention reduces waste by eliminating or minimizing the quantity of unacceptable carpet yarn that exists after a shutdown of the production line.

In another aspect of the present invention, the texturizing apparatus can also include a drive housing positioned proximate the inlet to the stuffer box to feed at least one yarn into the interior of the suffer box for texturizing. In one embodiment, the drive housing can comprise a false twist inlet that allows a plurality of yarns to enter the drive housing, a pair of opposing counter-rotating nip rollers positioned downstream of the false twist inlet, and a drive outlet positioned downstream of the pair of counter-rotating nip rollers and adjacent the inlet to the stuffer box through which the plurality of yarns can exit the interior of the drive housing and proceed into the interior of the stuffer box.

DETAILED DESCRIPTION OF THE DRAWINGS

These and other features of the preferred embodiments of the present invention will become more apparent in the detailed description in which reference is made to the appended drawings wherein.

Figure 8:
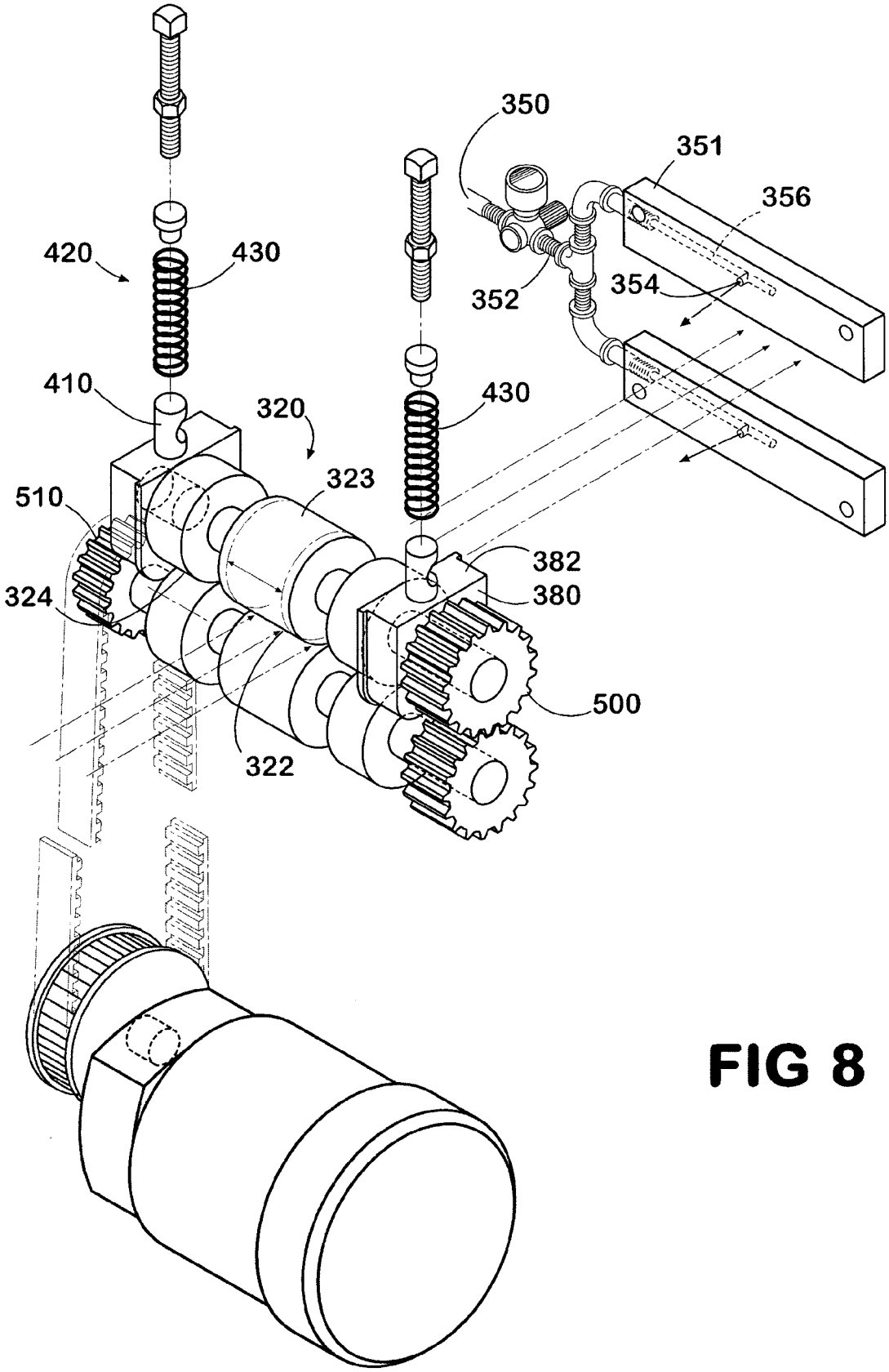

FIG. 8 is an exploded, partial perspective view of one embodiment of the texturizing apparatus, showing a pair of opposing counter-rotating nip rollers, a timing gear drive motor, and an air manifold having at least one outlet end that is positioned proximate at least one circumferential drive surfaces of the pair of counter-rotating nip rollers, and showing the yarn path width across the drive surface of the circumferential drive surfaces after the yarn passes out of the false twist inlet.

Figure 9:
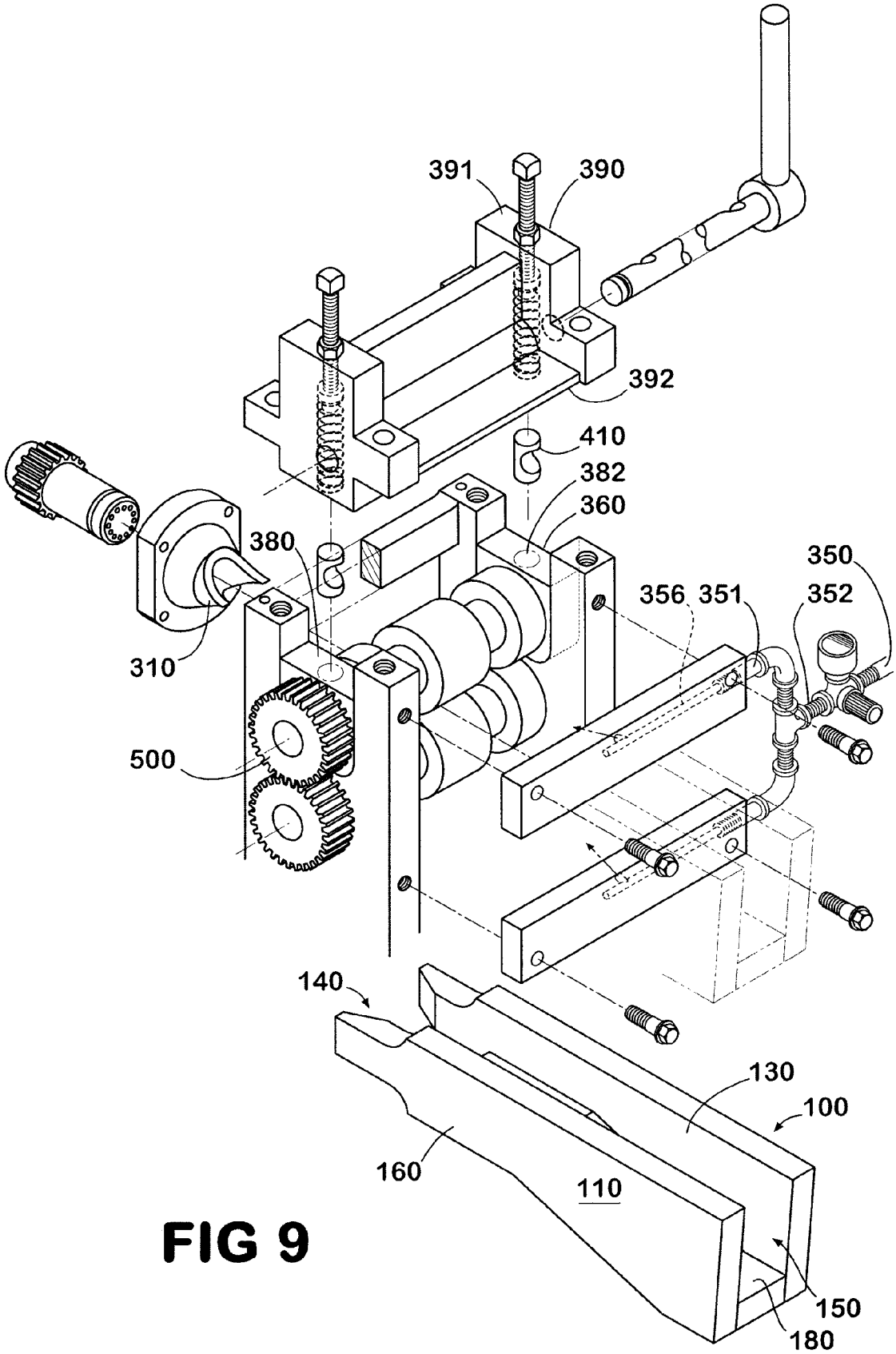

FIG. 9 is an exploded, partial perspective view of the drive housing and stuffer box of one embodiment of the texturizing apparatus.

Figure 1:
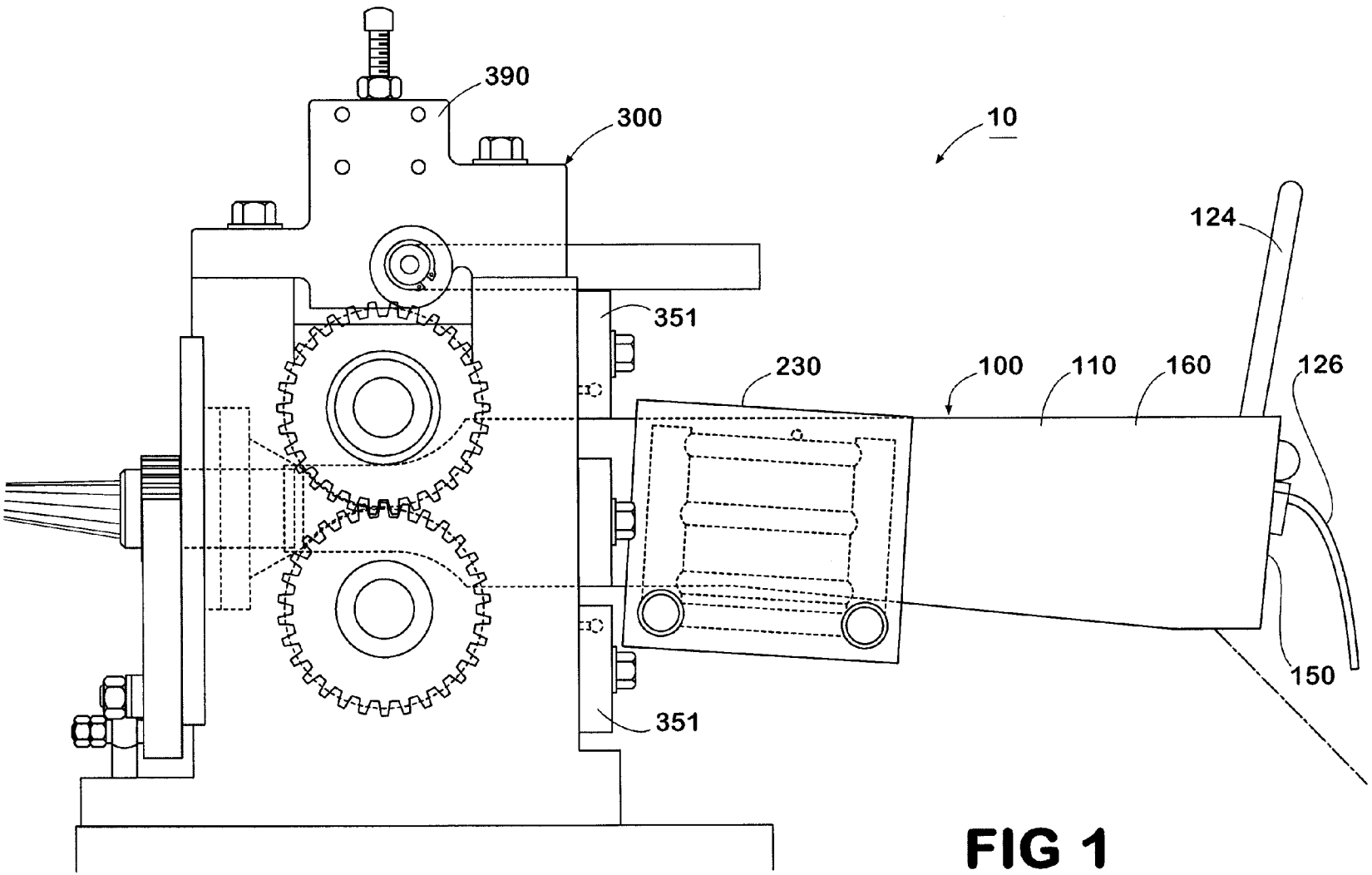
FIG. 1 is a side elevational view of one embodiment of the present invention for a texturizing apparatus.
Figure 2:
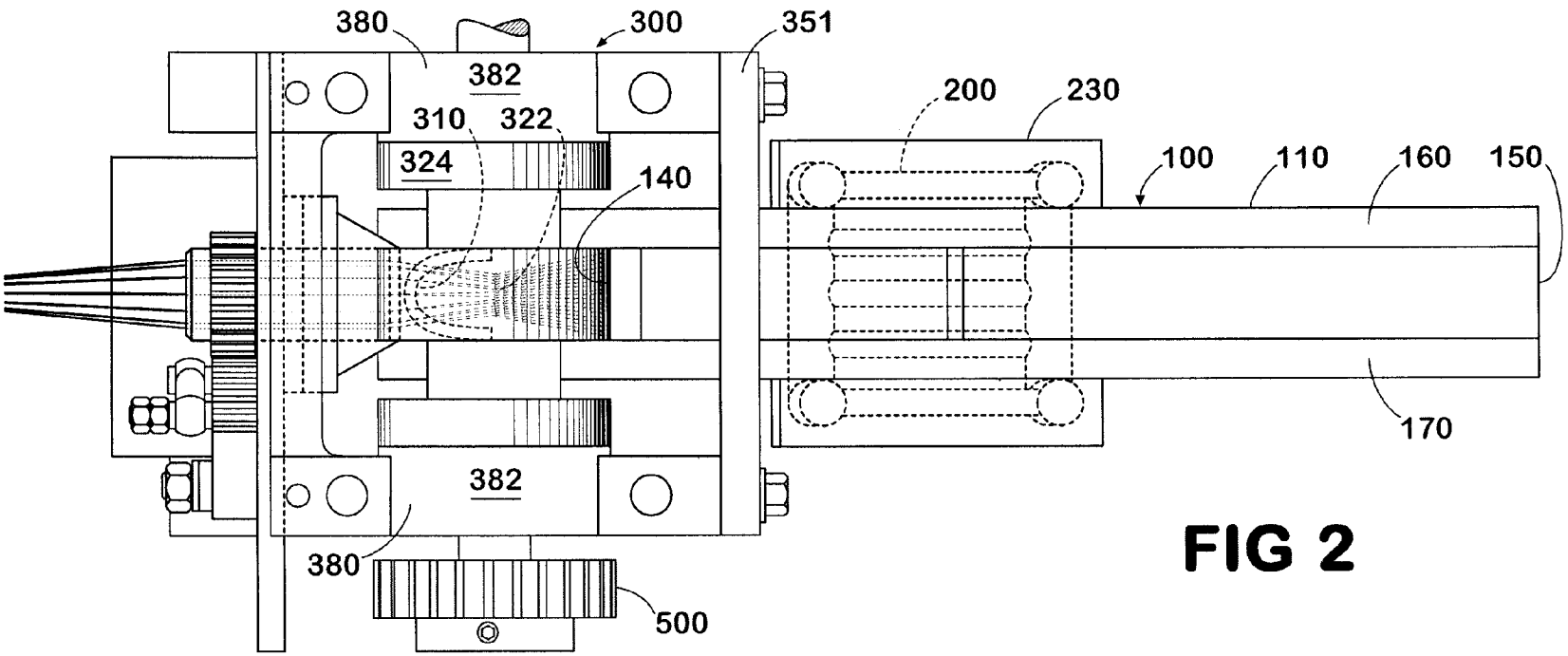
FIG. 2 is top, partial plan view of the texturizing apparatus of FIG. 1 showing a manifold disposed at least partially about a portion of a stuffer box.
Figure 3:
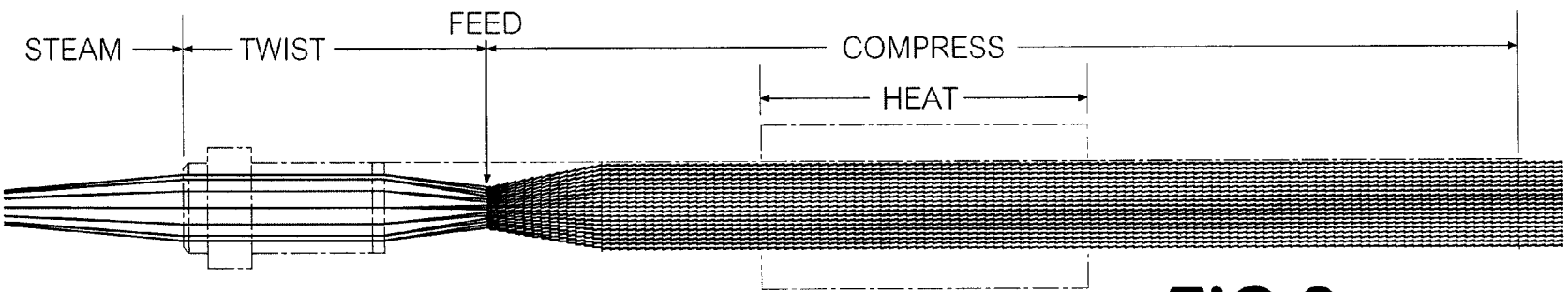
FIG. 3 shows an exemplary yarn path through the texturizing apparatus of FIG. 2.
Figure 4:
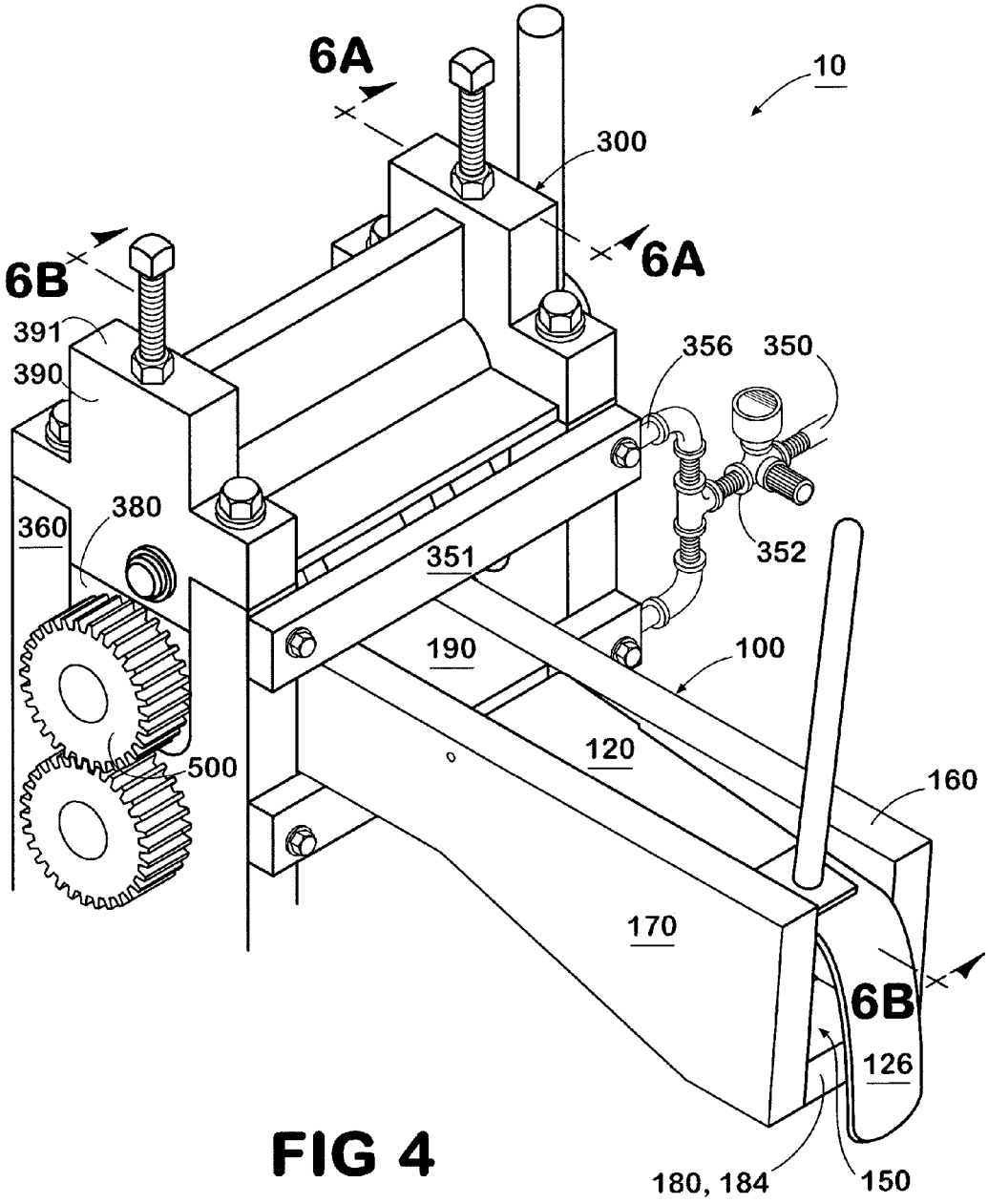
FIG. 4 is a partial perspective view of one embodiment of the texturizing apparatus showing an air manifold mounted to a portion of a drive housing, and showing an upper member of the drive housing releasably mounted to an upper portion of the two opposing troughs of a cradle defined in a upper portion of the drive housing.
Figure 5:
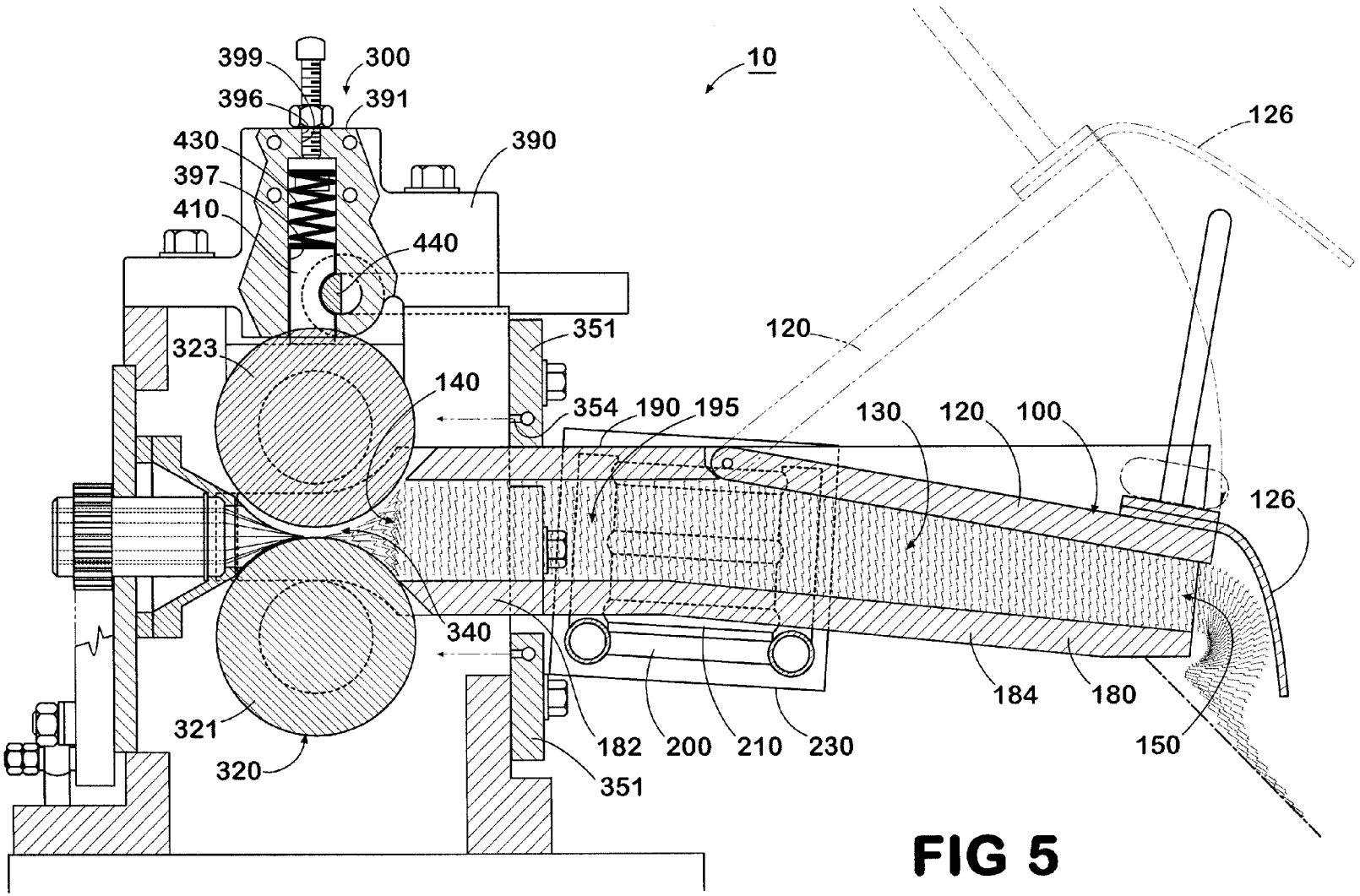
FIG. 5 is a cross-sectional view of an embodiment of the texturizing apparatus of the present invention, showing a pivot point of a movable flapper door of a stuffer box being spaced greater than the predetermined longitudinal length of the first portion of the bottom wall of the stuffer box.
Figure 6:
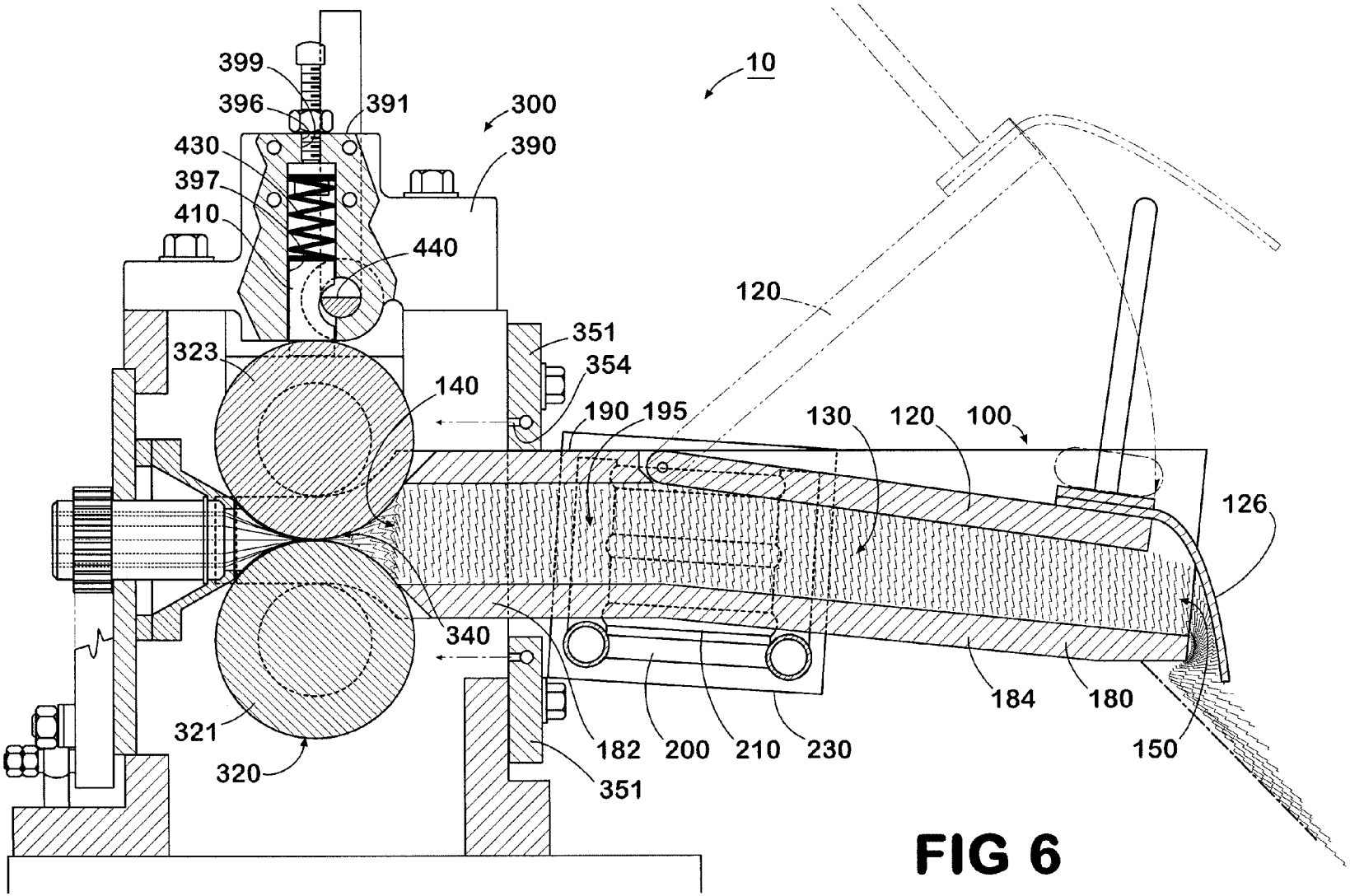
FIG. 6 is a cross-sectional view of the texturizing apparatus of FIG. 4, having a cross-section taken along line 6A-6A of the upper member of the drive housing and a cross-section taken along line 6B-6B of the texturizing apparatus.
Figure 7:
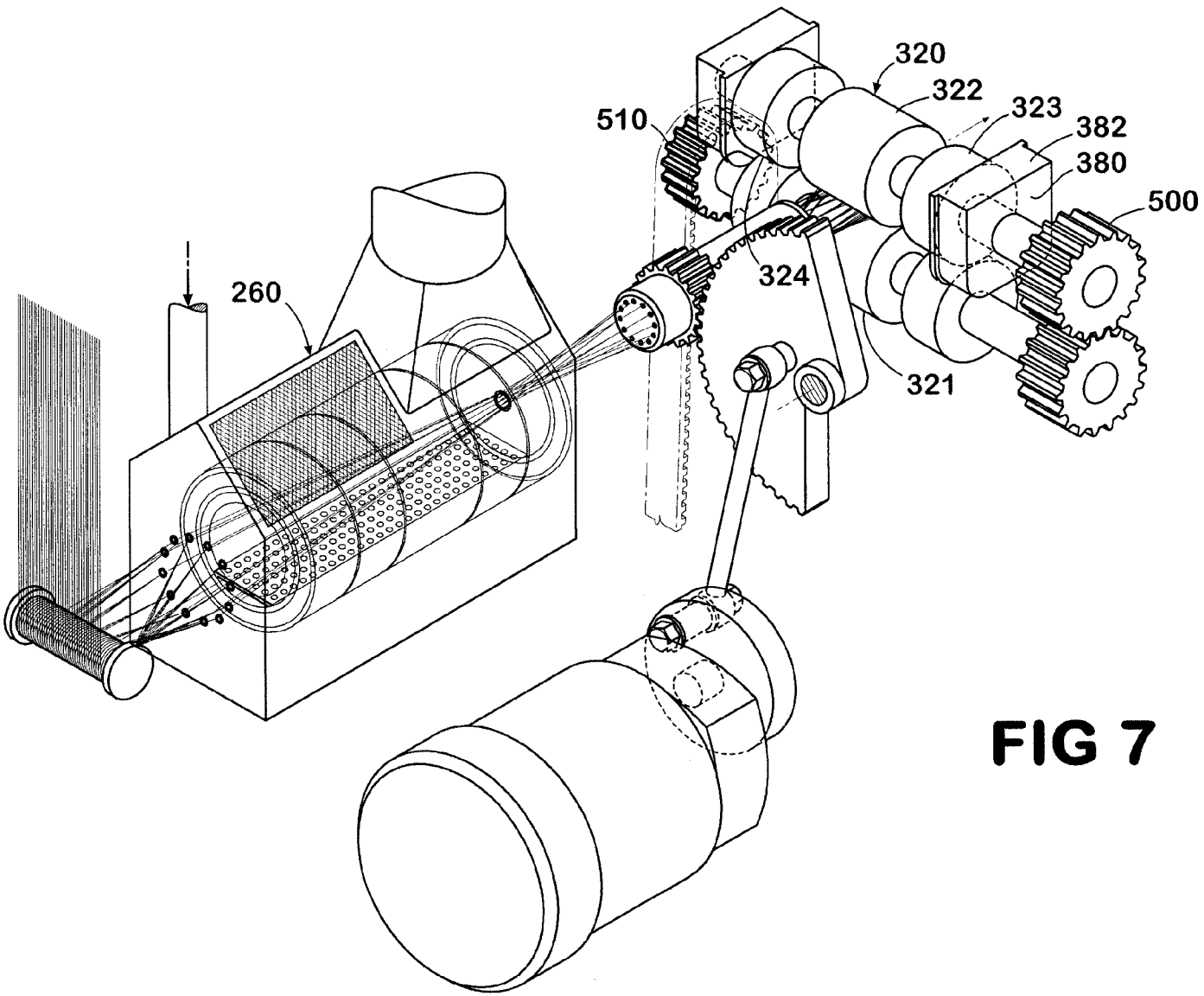
FIG. 7 is a partial, broken perspective view of one embodiment of the texturizing apparatus showing a pre-steamer, a pair of opposing counter-rotating nip rollers, and a false twist inlet assembly that includes a drive motor.
Figure 10:
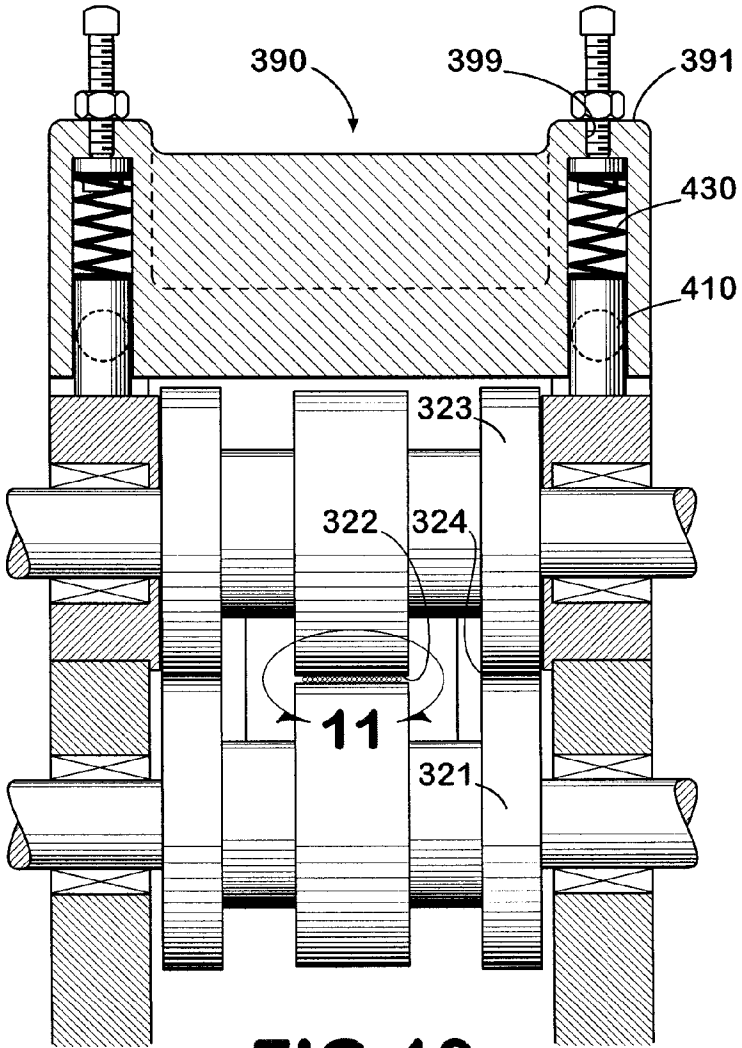

FIG. 10 is a cross-sectional view of one embodiment of the texturizing apparatus taken along line 10-10 of FIG. 1.

Figure 11:
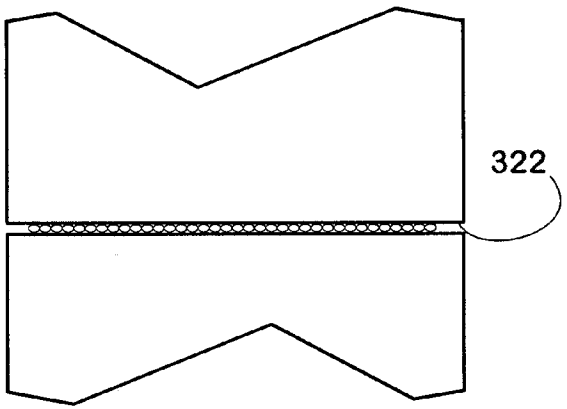

FIG. 11 is a partial, enlarged view of FIG. 10 wherein the filaments of the yarn are spread across the circumferential drive surfaces of the counter-rotating nip rollers, showing the spacing between the circumferential drive surfaces of the counter-rotating nip rollers when a spacing means is placed in a first, non-engaged position.

Figure 12:
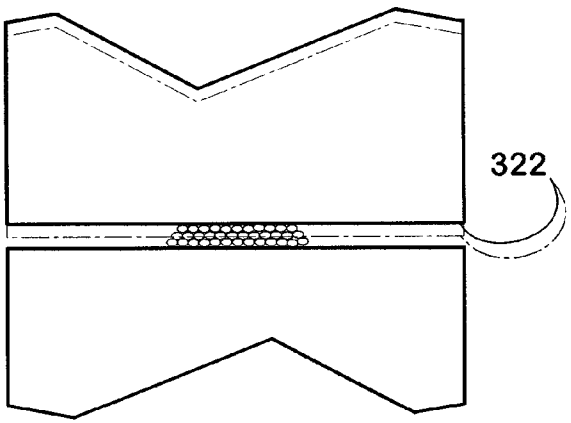

FIG. 12 is an exemplary partial, enlarged view of the texturizing apparatus of the present invention, showing the spacing between the circumferential drive surfaces of the counter-rotating nip rollers when a spacing means is placed in a second, engaged position.

DETAILED DESCRIPTION OF THE INVENTION

The present invention is more particularly described in the following exemplary embodiments that are intended as illustrative only since numerous modifications and variations therein will be apparent to those skilled in the art. As used herein, "a," "an," or "the" can mean one or more, depending upon the context in which it is used. The preferred embodiments are now described with reference to the figures, in which like reference characters indicate like parts throughout the several views.

Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment.

The present invention is a yarn texturizing apparatus 10 that resolves many of the issues previously stated. The texturizing apparatus 10 has a stuffer box 100 having an exterior surface 110, at least one movable flapper door 120, an interior 130, an inlet 140 of a size to allow a plurality of yarns to enter the interior 130, and an outlet 150 through which the yarns may exit the interior 130. The outlet 150 has an opening size that is partially defined by at least one movable flapper door 120. When the yarn is fed into the stuffer box 100 it compresses against the flapper door 120 and forms "bends" or "crimps" in the yarn. Once there is enough pressure to force the flapper door 120 open, the yarn exits the outlet 150 of the stuffer box 100 and falls onto a conveyor below. From there, the yarn travels to the heat-set oven where the "crimps" are "locked-in."

In one embodiment of the invention, the stuffer box 100 includes a first side wall 160, an opposing second side wall 170, and a bottom wall 180. In one example, the bottom portion of the first and second side walls 160, 170 is connected to bottom wall 180. The bottom wall 180 of one embodiment has a first elongate portion 182 extending from the inlet 140 and a second elongate portion 184 extending toward the outlet 150 of the stuffer box 100. The first portion 182 of the bottom wall 180 has a longitudinal axis. In one aspect, the second portion 184 of the bottom wall 180 extends downwardly away from the first portion 182 at an acute angle $\alpha$ relative to the longitudinal axis of the first portion 182. This acute angle $\alpha$ of the second portion 184 of the bottom wall 180 of the stuffer box 100 allows for the gravity acting on the yarns to assist moving the yarn through the stuffer box 100. Additionally, having the second portion 184 of the bottom wall 180 of the stuffer box 100 at an angle reduces the angle at which the yarn drops off from the outlet 150 of the stuffer box 100 to the aforementioned conveyer disposed below the outlet. In one aspect, the second portion 184 of the bottom wall 180 can be positioned parallel to the adjacent portion of the downstream conveyor.

Additionally, in one embodiment, the stuffer box 100 includes a top wall 190 connected to a top portion of the first and second side walls 160, 170. In this embodiment, the top wall 190, the first and second side walls 160, 170, and the first portion 182 of the bottom wall 180 defines an interior cavity 195 of a fixed volume. In one aspect, the movable flapper door 120 is pivotally connected to a portion of the first and second side walls 160, 170 proximate a distal end of the top wall 190. In another aspect, the first portion 182 of the bottom wall 180 can have a predetermined longitudinal length L from the inlet 140 of the stuffer box 100. In this aspect, the portion of the first and second side walls 160, 170 to which the movable flapper door 120 is pivotally connected is spaced from the inlet 140 a distance equal to or greater than the predetermined longitudinal length of the first portion 182 of the bottom wall 180. In this example, having the pivot point 122 of the movable flapper door 120 spaced at least as far from the inlet 140 of the stuffer box 100 as the first portion 182 of the bottom wall 180 of the stuffer box 100 assists in eliminating or minimizing a potential pinch point for the yarns passing through the interior 130 of the stuffer box 100. In one example, portions of the sides of the movable flapper door are spaced from the respective side wall of the stuffer box.

One embodiment of the invention has a means for resisting movement of the movable flapper door 120 from a closed position to an open position. In the closed position, a distal end portion of the movable flapper door 120 is positioned proximate a portion of the bottom wall 180. In the open position, the distal end portion of the movable flapper door 120 is spaced from the bottom wall 180 (i.e., the opening is larger). This resisting means may be gravity acting upon the mass of the flapper door 120 itself. Alternatively, the effective mass of the flapper door 120 can be increased. In this aspect, the flapper door 120 can have a rod 124 that extends upwardly, substantially perpendicular to the longitudinal axis of the flapper door 120. Small weights, in the shape of common washers, can be placed on the rod 124 to add additional resistance.

Gravity type resistance is not the only one way to provide resistance to the movable flapper door 120 of the present invention. Using spring force, as exemplified in U.S. Pat. No. 6,385,827, is also acceptable. Additionally, other means for resisting movement of the flapper door 120 include pneumatic systems, air cylinders, hydraulic cylinders, solenoids, electric switches, or the like. Still other embodiments are contemplated, such as a circular outlet opening that can be opened and closed similar to the operation or dilation of a camera lens. One skilled in the art will appreciate that other components may similarly be used to perform the step of increasing and decreasing the opening size of the outlet 150 of the stuffer box 100.

In another aspect, the movable flapper door 120 can have an elongated tongue member 126 extending from its distal end portion. A distal end of the tongue member 126 extends downwardly and away from the distal end portion of the movable flapper door 120. In one example, the distal end of the tongue member 126 is spaced from a distal end of the bottom wall 180 of the stuffer box 100. In one aspect, at least a portion of the tongue member 126 has a curved shape in the elongate dimension. However, this curve is not mandatory and one will appreciate that other shapes are contemplated. This elongated tongue member 126 assists guiding the crimped yarn from the outlet 150 of the stuffer box 100 to the conveyor below.

The stuffer box 100 and heat setting processes result in the yarns being uniformly textured since each portion of the yarn has an equal residence time within the stuffer box 100 to obtain the same amount of texturizing. As noted above, however, sometimes the processing line must be stopped for various planned or unplanned reasons. Once the production line stops, the method of the present invention becomes more consequential. Specifically, some of the yarns inherently remain within the interior 130 of the stuffer box 100 after the production line stops. In fact, usually such a quantity of yarn remains within the interior 130 of the stuffer box 100 that those yarns become overly textured as the yarn remaining within the stuffer box 100 cools during the period the processing line is shutdown.

The stuffer box 100 of the present invention includes a manifold 200 having at least one conduit 210. At least a portion of the manifold 200 overlies at least a portion of the exterior surface 110 of the stuffer box 100. In one embodiment, the manifold 200 overlies at least a portion of at least one of the first side wall 160, the second side wall 170, or the bottom wall 180 of the stuffer box 100. The conduit 210 of the manifold 200 has an influent end 212, an effluent end 214, and a body 216 extending between the influent and effluent ends 212, 214. At least a portion of the body 216 is positioned proximate a portion of the exterior surface 110 of the stuffer box 100. In one embodiment, the manifold 200 forms a U-shaped structure that is proximate the bottom and side walls of the stuffer box 100.

A pressurized heated fluid source is in communication with the influent end 212 so that pressurized heated fluid entering the influent end 212 of the conduit 210 travels through the body 216 and exits out of the effluent end 214. The heat from the pressurized heated fluid is transferred from the body 216 of the manifold 200 to the exterior surface 110 of the stuffer box 100 and thence into the interior 130 of the stuffer box 100. In one example, the heated pressurized fluid is steam. Preferably, the steam is heated to a temperature of between about 212° F. to about 300° F. and pressurized at approximately 2.0 lb/in2.

In order to regulate the introduction of the heated pressurized fluid into the manifold 200, one embodiment of the invention has at least one valve 220 disposed intermediate the pressurized heated fluid source and the influent end 212 of the conduit 210. Each valve 220 is selectively movable between a closed position, in which the pressurized heated fluid source is not in fluid communication with the manifold 200, and an open position, in which the pressurized heated fluid flows through the body 216 of the conduit 210 from the pressurized heated fluid source and into the body 216 of the conduit 210 so that heat is transferred to the interior 130 of the stuffer box 100. Thus, any yarn that remains within the stuffer box 100 during the shutdown is heated. This heating of the yarn prevents the yarn from getting cold and having the finish on the yarn coagulate, thereby preventing overcrimping of the yarn.

In one example, a protective housing 230 is provided that is adapted to overlie at least a portion of the manifold 200. The housing 230 can have insulation disposed therebetween an interior surface of the protective housing 230 and the at least a portion of the manifold 200. As one skilled in the art can appreciate, the housing 230 can increase the efficiency of the heat transfer to the stuffer box.

In one embodiment of the invention, there is a pre-steamer 260 which heats the yarn filaments upstream of the texturizing apparatus 10. By heating the filaments to a preferred temperature, the filaments become more flexible and ready to accept a crimp. The preferred temperature is between about 240° F. and 260° F. More preferably, the preferred temperature is about 250° F. In this embodiment, the pre-steamer 260 has an external steam source. When the heat-set production line is running, the steam is fed into the pre-steamer 260, which in turn heats the yarn filaments. In one embodiment, when the heat-set production line is temporarily shut down, the steam which is fed to the pre-steamer 260 can be rerouted to the manifold 200 of the stuffer box 100 to transfer heat to the stuffer box 100.

In another embodiment of the present invention, the texturizing apparatus 10 of this invention also comprises a drive housing 300. The drive housing 300 has a false twist inlet 310 to allow a plurality of yarns to enter the drive housing 300. The drive housing 300 also has a pair of opposing counter-rotating nip rollers 320 positioned downstream of the false twist inlet 310. Additionally, a drive outlet 340 is positioned downstream of the pair of counter-rotating nip rollers 320 through which the plurality of yarns may exit the drive housing 300. In one aspect, the pair of counter-rotating nip rollers 320 is positioned substantially horizontally. However, as one skilled in the art will note, the pair of nip rollers 320 can be mounted vertically or at any desired angle.

The pair of opposing counter-rotating nip rollers 320 includes a first nip roller 321 and a second nip roller 323. Each nip roller has a circumferential drive surface 322 adapted to engage the plurality of yarns and at least one circumferential spacer surface 324. The circumferential spacer surfaces 324 of the pair of nip rollers 320 are constructed and arranged to be in contact with each other such that the circumferential drive surfaces 322 of the pair of nip rollers 320 are spaced a predetermined distance apart. In one embodiment, both the circumferential drive surfaces 322 and the circumferential spacer surfaces 324 are disposed in an interior of the drive housing 300. In use, the circumferential drive surfaces 322 engage the plurality of yarns and feed them into the interior 130 of the stuffer box 100.

In one aspect of the present invention, the drive housing 300 of the texturizing apparatus 10 can also comprise a pressurized air source 350 and at least one air manifold 351 having an inlet end 352 and an outlet end 354. In this aspect, the inlet end of the at least one air manifold 351 is in fluid communication with the pressurized air source 350. The air manifold defines at least one air conduit 356 that is in fluid communication with the interior of the drive housing 300 proximate the at least one circumferential drive surfaces 322 of the respective first and second nip rollers 320. Thus, the pressurized air that enters the inlet end of the conduit 350 exits, at least partially, out of the at least one air conduit 356 into the interior of the drive housing 300 and acts to cool the drive surfaces 322. The remaining pressurized air exits the outlet end 354 of the air manifold. In one embodiment, when the heat set production line is stopped, the supply of air the air manifold is discontinued.

In one embodiment, each nip roller has one circumferential drive 322 surface positioned between two circumferential spacer surfaces 324. Preferably, when the spacer surfaces 324 of the two nip rollers 320 are in contact, the predetermined distance between the respective drive surfaces 322 is about and between about 0.001 inches to about 0.004 inches. More preferably, the predetermined distance is about 0.002 inches.

In one embodiment of the present invention, the drive housing 300 defines a cradle 360 in an upper portion of the drive housing 300. This cradle 360 defines a pair of opposed upright troughs 370. In this embodiment, the drive housing 300 has a pair of block members 380, each block member 380 constructed and arranged for slidable disposition therein one trough 370 of the cradle 360. The block members 380 can be constructed of any hard material, such as a substantially rigid polymeric material. The second nip roller 323 is rotatably mounted to the pair of block members 380. In one example, the first nip roller 321 is rotatably mounted in a fixed position in a lower portion of the drive housing 300. The mounting of the first and second nip rollers 321, 323 may be accomplished, for example, using conventional roller bearing assemblies or the like.

In use, the pair of block members 380 are slid down and positioned within the respective troughs 370 until the circumferential spacer surface(s) 324 of the second nip roller 323 makes contact with the circumferential spacer surface(s) of the first nip roller 321. In one embodiment of the present invention, the drive housing 300 has a means for applying compression to the second nip roller to force the respective circumferential spacer surfaces 324 of the pair of counter-rotating nip rollers 320 toward each other. This means for applying compression forcefully resists movement of the second nip roller 323 that would increase the predetermined spacing between the circumferential drive surfaces 322 of the first and second nip rollers 321, 323. Thus, the predetermined distance between the respective circumferential drive surfaces 322 is maintained.

In one embodiment, the means for applying compression to the second nip roller can selectively apply a compressive force onto a portion of an upper surface 382 of each block member 380 to displace or force the block members 380 downwardly therein the troughs 370 to drive the respective spacer surfaces 324 of the first and second nip rollers into contact. In one embodiment of the means to apply compression to the second nip roller 323, the drive housing 300 comprises an upper member 390 and a compression assembly 400. The upper member 390 of the drive housing 300 is constructed and arranged to mount to an upper portion of the two opposing troughs 370 of the cradle 360. The upper member 390 defines a pair of bores 395 that extend between a top surface 391 and a bottom surface 392 of the upper member 390. Each bore 395 has an upper portion 396 proximate the top surface 391 and a lower portion 397 proximate the bottom surface 392. In one example, at least a portion of the upper portion 396 of each bore 395 has a threaded surface 399.

In one aspect, the compression assembly 400 is mounted thereon the upper member 390 and is constructed and arranged to be in selective contact with a portion of the upper surface 382 of each block member 380. In one embodiment, the compression assembly 400 of the present invention comprises a pair of piston members 410, a pair of compression subassemblies 420, and a pair of bias elements 430. In one aspect, each piston member 410 is slidably disposed within a portion of the lower portion 397 of one bore 395 of the upper member 390 and a distal end of each piston member 410 is in selective contact with the portion of the upper surface 382 of each block member 380. In another aspect, each compression subassembly 420 is threadably connected to the threaded surface 399 of the upper portion 396 of the bore 395. In one example, the compression subassembly 420 is a threaded bolt that is sized and shaped to complementarily engage the threaded surface of the upper portion 396 of the bore 395.

Each compression subassembly 420 is selectively movable relative to the upper member 390 such that a distal end 422 of the compression subassembly 420 is movable relative to the upper surface 382 of the block member 380. In yet another aspect, each bias element 430 is positioned therein a portion of the upper portion 396 of one bore 395 therebetween the distal end of the compression subassembly 420 and a proximal end of the piston member 410.

The compression assembly 400 can also comprise means for spacing the distal end of each piston member from the upper surface 382 of each block member 380. In one embodiment, the spacing means is movable between a first, non-engaged, position, and a second engaged position. In the second engaged position, the piston member 410 is forcibly moved away from the upper surface 382 of the block member 380 against the compressive force applied by the bias element 430 to thereby relieve at least a portion of the compression on the second nip roller 323. In one example, a cam member 440, actuated by the operator, can be rotated between the first and second positions such that, as the cam member 440 is rotated to the second position, a portion of the cam member 440 engages a groove that is defined in the side of each of the piston members 410 and forces the respective piston members 410 to travel in an upward motion away from the upper surfaces 382 of the block members 380. The cam member is rotatably mounted therein the upper member and is constructed and arranged in select operative communication with a portion of the lower portion of each of the bores of the upper member. The noted upward motion compresses the bias elements 430 and relieves at least a portion of the applied compressive force on the second nip roller 323. As shown in FIG. 12, the temporary relief of applied compressive force on the second nip roller 323 allows the operator to increase the space between the drive surfaces 322 beyond the predetermined distance in order to thread yarns between the respective drive surfaces 322 of the two nip rollers 320.

In one example, the bias element 430 is a spring that has a generally planar platform 432 formed in a proximal end of the spring. The platform is adapted to engage the distal end of the compression subassembly 420. The bias element 430 allows the second nip roller 323 to move slightly should a large bunch of yarn come through the circumferential drive surfaces 322, thereby alleviating bunching of the yarns and avoiding a shut-down of the heat-set production line.

In one example, each bore 395 of the upper member 390 is substantially cylindrically shaped. In one aspect, the upper portion 396 of each bore 395 has a first diameter and the lower portion 397 of each bore 395 has a second diameter that is larger than the first diameter. Also, in one aspect, each piston member 410 is substantially cylindrically shaped.

Alternatively, as one skilled in the art will appreciate, the second nip roller 323 can be fixed in the housing such that the predetermined distance between the circumferential drive surfaces 322 is fixed. However, if means for compression are used, any practical means can be used, such as pneumatic means, solenoid means, clamp means, air cylinder means, hydraulic cylinder means, electric switch means, or the like.

The texturizing apparatus 10 can also include a means for counter-rotating the pair of counter-rotating nip rollers 320 in synchronization. One such means includes a spur gear 500 attached to each nip roller such that the teeth of each spur gear 500 are engaged with the other teeth of the other spur gear. Thus, when engaged, the spur gears 500 keep the rotation of the nip rollers 320 in synchronization. In this embodiment, the first nip roller 321 also has a timing gear 510 opposite the spur gear 500. The timing gear 510 is connected via a timing belt or chain to an electric motor. At least one of the spur gears 500 can be formed of a material that will fail if the nip rollers 320 become jammed or obstructed. As one skilled in the art can appreciate, the means for counter-rotating the nip rollers 320 in synchronization can be any number of devices, such as worm gears, bevel gears, helical gears, belt drives, etc.

In one embodiment, the counter-rotating means includes means for varying the speed of rotation of the pair of counter-rotating nip rollers. Here, the timing gear 510 can be connected via a timing belt or chain to an inverter-duty gear motor designed for use with adjustable speed controls. However, any conventional way to adjust the speed of the rotating timing gear may be used.

One example of the texturizing apparatus 10 contains circumferential drive surfaces 322 that have an elongate dimension transverse to the flow path of the yarn therethrough. In this example, the false twist inlet 310 tapers to an inlet opening 312 defined in a distal end of the false twist inlet 310. The inlet opening 312 has a diameter less than the elongate dimension of the circumferential drive surfaces 322. Therefore, the false twist inlet 310 channels the yarns to the circumferential drive surfaces about an elongate dimension w. Additionally, the false twist inlet 310 can be positioned such that the inlet opening 312 is proximate a middle portion of the circumferential drive surfaces 322 of the first and second nip rollers 320, thereby keeping the yarns completely on the drive surfaces 322 and minimizing the migration of the yarns to the edges of the circumferential drive surfaces 322.

In another example, the distal end of the false twist inlet 310 is sized and shaped to complementarily overlie portions of the circumferential drive surfaces 322. In this embodiment, the distal end of the false twist inlet 310 forms a notch that is positioned into the crease formed by the counter rotating nip rollers 320 such that the distance between the distal end of the false twist inlet 310 and the circumferential drive surfaces 322 is minimized.

Similarly, the stuffer box 100 of the texturizing apparatus 10 can be made to complement the outlet of the drive housing 300. Here, the drive outlet 340 of the drive housing 300 is positioned proximate the inlet 140 of the stuffer box 100. In this embodiment, each nip roller defines a plurality of grooves 326, 336. Each groove 326, 336 is positioned at each respective edge of the circumferential drive surfaces 322 of the first and second nip rollers 320. In operation, a portion of the proximal end portions of one of the side walls 160, 170 of the stuffer box 100 is constructed and arranged to be positioned therein a portion of the groove 326, 336 such that a portion of side wall 160, 170 is positioned proximate the edges of the circumferential drive surfaces 322. One groove 326, 336 is positioned between the circumferential drive surface 322 and each circumferential spacer surface 324 of each nip roller.

As with the false twist inlet 310, the respective proximal end portions of the top wall 190 and bottom wall 180 of the stuffer box 100 are complementarily shaped to closely overlie portions of the circumferential drive surface 322 of the respective first and second nip roller 320. In this embodiment, the respective proximal end portions of the top wall 190 and bottom wall 180 of the stuffer box 100 have a tapered shape that narrows in a lengthwise direction toward the proximal end of the respective top and bottom walls 190, 180. In this embodiment, the respective proximal end portions of the top wall 190 and bottom wall 180 of the stuffer box 100 mate into the crease formed by the counter rotating nip rollers 320 such that the distance between the proximal end portions of the top wall 190 and bottom wall 180 of the stuffer box 100 and the circumferential drive surfaces 322 is minimized.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A texturizing apparatus, comprising:

a drive housing, comprising:

a false twist inlet to allow a plurality of yarns to enter the drive housing;

a pair of opposing counter-rotating nip rollers positioned downstream of the false twist inlet, the pair of opposing counter-rotating nip rollers including a first nip roller and a second nip roller, each nip roller having a circumferential drive surface adapted to engage the plurality of yarns and at least one circumferential spacer surface, wherein the at least one circumferential spacer surfaces of the pair of nip rollers are constructed and arranged to contact with each other such that the circumferential drive surfaces of the pair of nip rollers are spaced a predetermined distance apart;

a means for applying compression to the second nip roller to force the at least one circumferential spacer surfaces of the pair of nip rollers toward each other; and a drive outlet positioned downstream of the pair of counter-rotating nip rollers through which the plurality of yarns may exit the drive housing.

2. The texturizing apparatus of claim 1, wherein the predetermined distance is about and between about 0.001 inches to about 0.004 inches.

3. The texturizing apparatus of claim 1, wherein the circumferential drive surface and the at least one circumferential spacer surface are disposed in an interior of the drive housing.

4. The texturizing apparatus of claim 1, wherein the pair of counter-rotating nip rollers is rotatably mounted therein the drive housing and are positioned substantially horizontal.

5. The texturizing apparatus of claim 4, wherein the first nip roller is rotatably mounted in a fixed position in a lower portion of the drive housing.

6. The texturizing apparatus of claim 5, wherein the drive housing defines a cradle in an upper portion of the drive housing, the cradle defining a pair of opposed upright troughs, wherein the drive housing further comprises a pair of opposing block members, each block member 380 constructed and arranged for slidable disposition therein one trough of the cradle, wherein the second nip roller is rotatably mounted to the pair of block members.

7. The texturizing apparatus of claim 6, wherein the means for applying compression forcefully resists movement of the second nip roller that would increase spacing between the circumferential drive surfaces of the first and second nip rollers beyond the predetermined distance.

8. The texturizing apparatus of claim 7, wherein the means for applying compression to the second nip roller can selectively apply a compressive force onto a portion of an upper surface of each block member to displace the block members downwardly therein the troughs such that the spacer surface of the first and second nip rollers can be positioned in operational contact.

9. The texturizing apparatus of claim 7, wherein the means for applying compression to the second nip roller comprises an upper member and a compression assembly, the upper member being constructed and arranged to mount to an upper portion of the opposing troughs of the cradle, the upper member defining a pair of bores extending between a top surface and a bottom surface of the upper member, each bore having an upper portion proximate the top surface and a lower portion proximate the bottom surface, at least a portion of the upper portion proximate the top surface having a threaded surface, the compression assembly being mounted thereto the upper member and is constructed and arranged to be in selective contact with a portion of an upper surface of each block member.

10. The texturizing apparatus of claim 9, wherein the compression assembly comprises:

a pair of piston members, each piston member being slidably disposed within a portion of the lower portion of one bore;

a pair of compression subassemblies, each compression subassembly being threadably connected to the threaded surface of the upper portion of the bore, wherein each compression subassembly is selectively movable relative to the upper member; and a pair of bias elements, each bias element being positioned therein a portion of the upper portion of one bore therebetween a distal end of the compression subassembly and a proximal end of the piston member, wherein a distal end of each piston member is in selective contact with the portion of the upper surface of each block member.

11. The texturizing apparatus of claim 10, wherein the compression assembly further comprises means for spacing the distal end of each cylindrical member from the upper surface of each block member.

12. The texturizing apparatus of claim 11, wherein the spacing means is movable between a first, non-engaged, position, and a second engaged position, in which the piston member is forceably moved away from the upper surface of the block member against the compressive force applied by the bias element to thereby relieve at least a portion of the compression on the second nip roller.

13. The texturizing apparatus of claim 10, wherein the bias element is a spring having a platform formed in a proximal end of the spring that is adapted to engage the distal end of the compression subassembly.

14. The texturizing apparatus of claim 10, wherein each bore is substantially cylindrically shaped, wherein the upper portion of each bore has a first diameter and the lower portion of each bore has a second diameter that is larger than the first diameter, and wherein each piston member is substantially cylindrically shaped.

15. The texturizing apparatus of claim 1, wherein the circumferential drive surface has a lengthwise dimension, wherein the false twist inlet tapers to an inlet opening defined in a distal end of the false twist inlet, the inlet opening having a diameter less than the lengthwise dimension of the circumferential drive surface.

16. The texturizing apparatus of claim 15, wherein the false twist inlet is positioned so that the inlet opening is proximate a middle portion of the circumferential drive surfaces of the first and second nip rollers.

17. The texturizing apparatus of claim 15, wherein the distal end of the false twist inlet is sized and shaped to complementarily overlie portions of the circumferential drive surfaces.

18. The texturizing apparatus of claim 6, wherein the block members are formed of a substantially rigid polymeric material.

19. The texturizing apparatus of claim 1, further comprising a stuffer box having an exterior surface, at least one movable flapper door, an interior, a box inlet of a size to allow the plurality of yarns to enter the interior, and a box outlet through which the yarns may exit the interior, the box outlet having an opening size partially defined by the at least one movable flapper door, wherein the drive outlet is positioned proximate the box inlet.

20. The texturizing apparatus of claim 19, wherein the stuffer box comprises a first side wall, an opposed side wall, a bottom wall, and an opposed top wall, a bottom portion of the first and second side walls being connected to the bottom wall and a top portion of the first and second side walls being connected to the top wall, wherein proximal end portions of the first and second side walls, the top wall and the bottom wall define the box inlet.

21. The texturizing apparatus of claim 20, wherein each nip roller defines a plurality of grooves, one groove being positioned at each respective edge of the circumferential drive surfaces of the first and second nip rollers, wherein a portion of the proximal end portions of each first and second side walls is positioned therein a portion of the groove such that a portion of each first and second side wall is positioned proximate the edges of the circumferential drive surfaces.

22. The texturizing apparatus of claim 21, wherein one groove is positioned therebetween the circumferential drive surface and the at least one circumferential spacer surface of each nip roller.

23. The texturizing apparatus of claim 20, wherein the respective proximal end portions of the top wall and bottom wall are complementarily shaped to closely overlie portions of the circumferential drive surface of the respective first and second nip roller.

24. The texturizing apparatus of claim 19, further comprising:

a manifold having at least one conduit, at least a portion of the manifold overlying at least a portion of an exterior surface of the stuffer box, each conduit of the manifold having an influent end, an effluent end, and a body extending between the influent and effluent ends, wherein at least a portion of the body is positioned proximate a portion of the exterior surface of the stuffer box; and a pressurized heated fluid source in communication with the influent end so that pressurized heated fluid entering the influent end of the conduit travels through the body and exits out of the effluent end, wherein heat is transferred from the body of the manifold to the exterior surface of the stuffer box and into the interior of the stuffer box to interface with the yarns therein.

25. The texturizing apparatus of claim 1, further comprising:

a. a pressurized air source; and b. at least one air conduit having an inlet end and an outlet end, wherein the inlet end is in fluid communication with the pressurized air source and the outlet end is in communication with the interior of the drive housing proximate the at least one circumferential drive surfaces of the respective first and second nip rollers so that pressurized air entering the inlet end exits out of the outlet end into the interior of the drive housing.

* * * * *